US010494227B2

(12) United States Patent
Hu et al.

(10) Patent No.: US 10,494,227 B2
(45) Date of Patent: Dec. 3, 2019

(54) BRAKING SYSTEM RESETTING MECHANISM FOR A HOISTED STRUCTURE

(71) Applicant: OTIS ELEVATOR COMPANY, Farmington, CT (US)

(72) Inventors: Guohong Hu, Farmington, CT (US); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 231 days.

(21) Appl. No.: 15/317,702

(22) PCT Filed: Jun. 10, 2015

(86) PCT No.: PCT/US2015/035080
§ 371 (c)(1),
(2) Date: Dec. 9, 2016

(87) PCT Pub. No.: WO2015/191695
PCT Pub. Date: Dec. 17, 2015

(65) Prior Publication Data

US 2017/0107078 A1 Apr. 20, 2017

Related U.S. Application Data

(60) Provisional application No. 62/011,333, filed on Jun. 12, 2014.

(51) Int. Cl.
*B66B 5/22* (2006.01)
*B66B 5/18* (2006.01)
*B66B 5/04* (2006.01)

(52) U.S. Cl.
CPC ..... *B66B 5/22* (2013.01); *B66B 5/04* (2013.01); *B66B 5/18* (2013.01)

(58) Field of Classification Search
CPC ..... B66B 5/22; B66B 5/04; B66B 5/18
See application file for complete search history.

(56) References Cited

U.S. PATENT DOCUMENTS 5,096,020 A * 3/1992 Korhonen ..... B66B 5/22 187/359
5,226,508 A * 7/1993 Ericson ..... B66D 5/14 187/254

(Continued)

FOREIGN PATENT DOCUMENTS

CN 101372302 A 2/2009
CN 103183266 A 7/2013

(Continued)

OTHER PUBLICATIONS

English translation of the First Office Action and Search Report regarding related CN App. No. 201580031260.8; dated Jun. 4, 2018.

(Continued)

*Primary Examiner* — Michael A Riegelman
(74) *Attorney, Agent, or Firm* — Cantor Colburn LLP

(57) ABSTRACT

A braking system resetting mechanism for a hoisted structure includes a guide rail (14) and a brake member (10). Also included is a brake member actuation mechanism (12) operatively coupled to the brake member and configured to magnetically engage the guide rail to actuate the brake member from a non-braking position to a braking position. Further included is an outer structure having a slot (64) configured to guide the brake member actuation mechanism, wherein the slot includes a first angled region and a second angled region that intersect at an outer location. Also included is a spring loaded lever (202) operatively coupled to the outer structure and configured to engage the brake member actuation mechanism during a resetting operation, wherein the spring loaded lever biases the brake member actuation mechanism toward the outer location of the slot of (Continued)

the outer structure to disengage the brake member actuation mechanism from the guide rail.

19 Claims, 10 Drawing Sheets

(56) References Cited

U.S. PATENT DOCUMENTS 5,228,540 A * 7/1993 Glaser ..... B66B 5/04 187/355
5,628,385 A 5/1997 Yumura et al.
5,782,319 A * 7/1998 Woodruff ..... B66B 5/22 187/376
6,109,398 A * 8/2000 Lempio ..... B66B 5/18 187/376
6,161,653 A 12/2000 Skalski et al.
6,173,813 B1 * 1/2001 Rebillard ..... B66B 5/06 187/287
6,371,261 B1 * 4/2002 Thompson ..... B66B 5/22 187/370
6,478,123 B2 11/2002 Seggebruch et al.
7,128,189 B2 10/2006 Maury et al.
7,299,898 B2 * 11/2007 Husmann ..... B66B 5/20 187/373
7,533,763 B2 5/2009 Kattainen et al.
7,540,358 B2 6/2009 Okamoto et al.
7,575,099 B2 8/2009 Oh et al.
7,614,482 B2 11/2009 Shikai et al.
7,849,975 B2 12/2010 Ketonen et al.
7,954,605 B2 6/2011 Fonteneau et al.
8,157,061 B2 4/2012 Gremaud et al.
8,177,035 B2 5/2012 Ueda et al.
8,307,953 B2 11/2012 Ferreira
8,312,972 B2 * 11/2012 Gremaud ..... B66B 5/22 187/371
8,408,364 B2 4/2013 Kangas
8,534,444 B2 9/2013 Senger
8,631,909 B2 1/2014 Draper et al.
2011/0088983 A1 * 4/2011 Sirigu ..... B66B 5/22 187/373
2011/0226560 A1 9/2011 Husmann
2011/0308895 A1 * 12/2011 Shen ..... B66B 5/22 187/359
2012/0000731 A1 * 1/2012 Schienda ..... B66B 5/06 187/305
2013/0081908 A1 4/2013 Meierhans et al.
2013/0133984 A1 5/2013 Faruk et al.
2013/0240301 A1 9/2013 Antti et al.
2013/0248296 A1 9/2013 Husmann
2013/0248298 A1 9/2013 Osmanbasic
2014/0008157 A1 * 1/2014 Terry ..... B66B 5/18 187/359
2014/0041967 A1 * 2/2014 Wei ..... B66B 5/22 187/350
2015/0240894 A1 * 8/2015 Piech ..... F16D 63/008 188/163
2016/0200549 A1 * 7/2016 Billard ..... B66B 5/22 188/65.1
2016/0236904 A1 * 8/2016 Witczak ..... B66B 5/22
2016/0289045 A1 * 10/2016 Osmanbasic ..... B66B 5/22
2017/0001835 A1 * 1/2017 Hu ..... B66B 5/18
2017/0066627 A1 3/2017 Hu et al.
2017/0107078 A1 * 4/2017 Hu ..... B66B 5/18
2017/0129741 A1 * 5/2017 Hu ..... F16D 59/02
2017/0217726 A1 * 8/2017 Guilani ..... B66B 5/22
2017/0283215 A1 * 10/2017 Hu ..... B66B 5/22
2017/0283216 A1 * 10/2017 Marvin ..... B66B 5/0031
2017/0283217 A1 * 10/2017 Marvin ..... B66B 5/0031
2017/0291797 A1 * 10/2017 Hu ..... B66B 5/0031
2017/0291798 A1 * 10/2017 Hu ..... B66B 5/22
2018/0162693 A1 * 6/2018 Hu ..... B66B 5/06
2018/0162694 A1 * 6/2018 Hu ..... B66B 5/22
2018/0282122 A1 * 10/2018 Sudi ..... B66B 5/0093
2018/0327224 A1 11/2018 Billard et al.
2019/0002238 A1 * 1/2019 Bogli ..... B66B 5/0025
2019/0062113 A1 * 2/2019 Hu ..... B66B 9/00

FOREIGN PATENT DOCUMENTS

CN 103231959 A 8/2013
EP 1813566 A1 8/2007
EP 2439163 B1 3/2014
WO 2015047391 A1 4/2015
WO 2015191696 A1 12/2015

OTHER PUBLICATIONS

English translation of the First Office Action and Search Report regarding related CN App. No. 201580031374.2; dated Jun. 4, 2018.
International Preliminary Report on Patentability regarding related PCT App. No. US2015/035080; dated Dec. 15, 2016; 8 pgs.
International Preliminary Report on Patentability regarding related PCT App. No. US2015/035083; dated Dec. 15, 2016; 7 pgs.
Search Report regarding related App. No. PCT/US2015/035083; dated Aug. 20, 2015.
Search Report regarding related App. No. PCT/US2015/035080; dated Aug. 19, 2015.

* cited by examiner

BRAKING SYSTEM RESETTING MECHANISM FOR A HOISTED STRUCTURE

CROSS-REFERENCES TO RELATED APPLICATIONS

This patent application claims the benefit of priority to International Patent Application Serial No. PCT/US2015/035080, filed Jun. 10, 2015, and claims the benefit of priority to U.S. Provisional Patent Application Ser. No. 62/011,333, filed Jun. 12, 2014, each of which are incorporated herein by reference in their entirety.

BACKGROUND OF THE INVENTION

The embodiments herein relate to braking systems and, more particularly, to a brake member actuation mechanism for braking systems, such as those employed to assist in braking a hoisted structure.

Hoisting systems, such as elevator systems and crane systems, for example, often include a hoisted structure (e.g., elevator car), a counterweight, a tension member (e.g., rope, belt, cable, etc.) that connects the hoisted structure and the counterweight. During operation of such systems, a safety braking system is configured to assist in braking the hoisted structure relative to a guide member, such as a guide rail, in the event the hoisted structure exceeds a predetermined velocity or acceleration. After deployment of the safety braking system, the system must be reset to a default state or position to be ready for use once more. This often requires manual manipulation of the resetting device and is a complicated and tedious procedure.

BRIEF DESCRIPTION OF THE INVENTION

According to one embodiment, a braking system resetting mechanism for a hoisted structure includes a guide rail configured to guide movement of the hoisted structure. Also included is a brake member operatively coupled to the hoisted structure and having a brake surface configured to frictionally engage the guide rail, the brake member moveable between a braking position and a non-braking position. Further included is a brake member actuation mechanism operatively coupled to the brake member and configured to magnetically engage the guide rail to actuate the brake member from the non-braking position to the braking position. Yet further included is an outer structure having a slot configured to guide the brake member actuation mechanism, wherein the slot includes a first angled region and a second angled region that intersect at an outer location. Also included is a spring loaded lever operatively coupled to the outer structure and configured to engage the brake member actuation mechanism during a resetting operation, wherein the spring loaded lever biases the brake member actuation mechanism toward the outer location of the slot of the outer structure to disengage the brake member actuation mechanism from the guide rail.

In addition to one or more of the features described above, or as an alternative, further embodiments may include that the spring loaded lever comprises a torsional spring.

In addition to one or more of the features described above, or as an alternative, further embodiments may include that the torsional spring is a single spring located on one side of the spring loaded lever.

In addition to one or more of the features described above, or as an alternative, further embodiments may include that the torsional spring is a double spring located on two sides of the spring loaded lever.

In addition to one or more of the features described above, or as an alternative, further embodiments may include that the brake member actuation mechanism is moveable relative to the outer structure from an actuated state to a reset state.

In addition to one or more of the features described above, or as an alternative, further embodiments may include that the brake member actuation mechanism slides downwardly relative to the outer structure as the hoisted structure is raised.

In addition to one or more of the features described above, or as an alternative, further embodiments may include that the brake member actuation mechanism engages the spring loaded lever during movement from the actuated state to the reset state.

In addition to one or more of the features described above, or as an alternative, further embodiments may include that the spring loaded lever rotationally biases the brake member actuation mechanism out of contact from the guide rail to a default state as the hoisted structure is lowered.

In addition to one or more of the features described above, or as an alternative, further embodiments may include that the brake member actuation mechanism includes a container operatively coupled to the brake member. Also included is a brake actuator formed of a magnetic material disposed within the container and configured to be electronically actuated to magnetically engage the guide rail upon detection of the hoisted structure exceeding a predetermined condition, wherein the magnetic engagement of the brake actuator and the guide rail actuates movement of the brake member into the braking position. Further included is a brake actuator housing that directly contains the brake actuator. Yet further included is a slider at least partially surrounding the brake actuator housing and slidably disposed within the container.

According to another embodiment, a braking system resetting mechanism for a hoisted structure includes a guide rail configured to guide movement of the hoisted structure. Also included is a brake member operatively coupled to the hoisted structure and having a brake surface configured to frictionally engage the guide rail, the brake member moveable between a braking position and a non-braking position. Further included is a brake member actuation mechanism operatively coupled to the brake member and configured to magnetically engage the guide rail to actuate the brake member from the non-braking position to the braking position. Yet further included is an outer structure having a slot configured to guide the brake member actuation mechanism, wherein the slot includes a first angled region and a second angled region that intersect at an outer location. Also included is an electromagnetic device operatively coupled to the outer structure and located proximate an end of the brake member actuation mechanism in a reset state of the brake member actuation mechanism, wherein the electromagnetic device biases the brake member actuation mechanism toward the outer location of the slot of the outer structure to disengage the brake member actuation mechanism from the guide rail.

In addition to one or more of the features described above, or as an alternative, further embodiments may include that the electromagnetic device comprises a ferrite material configured to magnetically attract the brake member actuation mechanism during an activated state of the electromagnetic device to oppose the magnetic attraction of the brake member actuation device to the guide rail.

In addition to one or more of the features described above, or as an alternative, further embodiments may include a spring configured to bias the brake member actuation mechanism toward the outer location of the slot of the outer structure to disengage the brake member actuation mechanism from the guide rail.

In addition to one or more of the features described above, or as an alternative, further embodiments may include that the brake member actuation mechanism is moveable relative to the outer structure from an actuated state to a reset state.

In addition to one or more of the features described above, or as an alternative, further embodiments may include that the brake member actuation mechanism slides downwardly relative to the outer structure as the hoisted structure is raised.

In addition to one or more of the features described above, or as an alternative, further embodiments may include that the brake member actuation mechanism engages the spring and the electromagnetic device during movement from the actuated state to the reset state.

In addition to one or more of the features described above, or as an alternative, further embodiments may include that the brake member actuation mechanism includes a container operatively coupled to the brake member. Also included is a brake actuator formed of a magnetic material disposed within the container and configured to be electronically actuated to magnetically engage the guide rail upon detection of the hoisted structure exceeding a predetermined condition, wherein the magnetic engagement of the brake actuator and the guide rail actuates movement of the brake member into the braking position. Further included is a brake actuator housing that directly contains the brake actuator. Yet further included is a slider at least partially surrounding the brake actuator housing and slidably disposed within the container.

According to yet another embodiment, a braking system resetting mechanism for a hoisted structure includes a guide rail configured to guide movement of the hoisted structure. Also included is a brake member operatively coupled to the hoisted structure and having a brake surface configured to frictionally engage the guide rail, the brake member moveable between a braking position and a non-braking position. Further included is a brake member actuation mechanism operatively coupled to the brake member and configured to magnetically engage the guide rail to actuate the brake member from the non-braking position to the braking position. Yet further included is an outer structure having a slot configured to guide the brake member actuation mechanism, wherein the slot includes a first angled region and a second angled region that intersect at an outer location. Also included is a fork member having a first segment and a second segment, the fork member pivotally coupled to the outer structure, wherein the first segment and the second segment are configured to engage the brake member actuation mechanism. Further included is a spring configured to bias the first segment of the fork member to disengage the brake member actuation mechanism from the guide rail.

In addition to one or more of the features described above, or as an alternative, further embodiments may include that the second end of the fork member is configured to bias the brake member actuation mechanism toward the guide rail to increase a friction force between the brake member actuation mechanism and the guide rail.

In addition to one or more of the features described above, or as an alternative, further embodiments may include a plurality of ridges along the slot, wherein each of the plurality of ridges biases the brake member actuation mechanism away from the guide rail.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
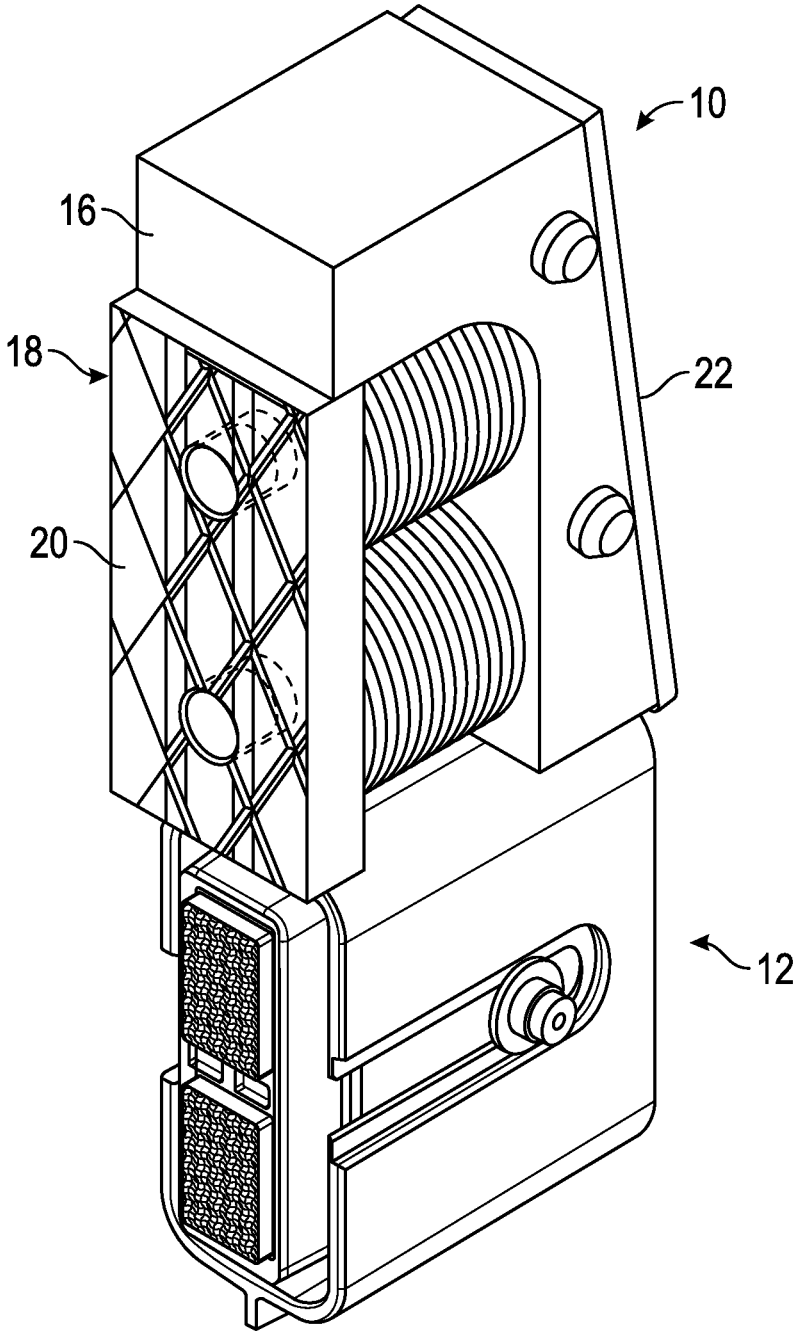
FIG. 1 is a perspective view of a braking system for a hoisted structure according to a first embodiment.
Figure 3:
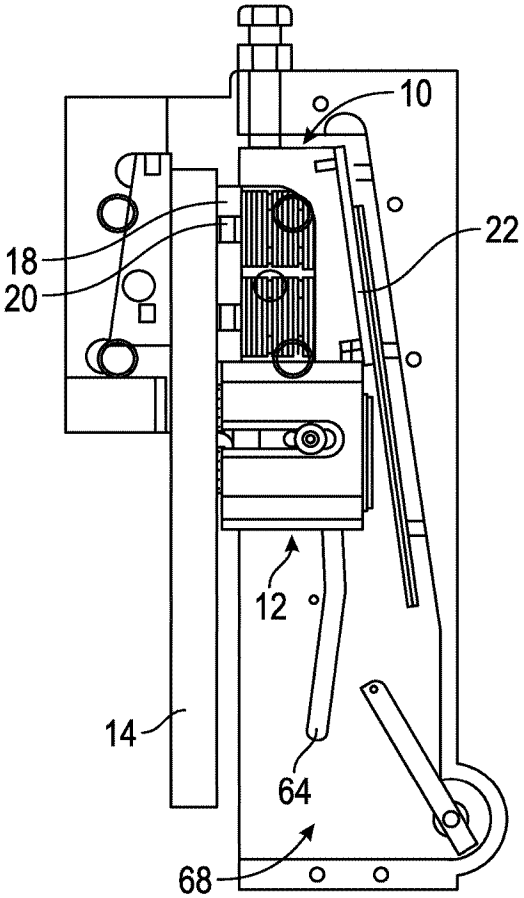
FIG. 3 is a schematic illustration of the braking system of FIG. 1 in a braking position.
Figure 2:
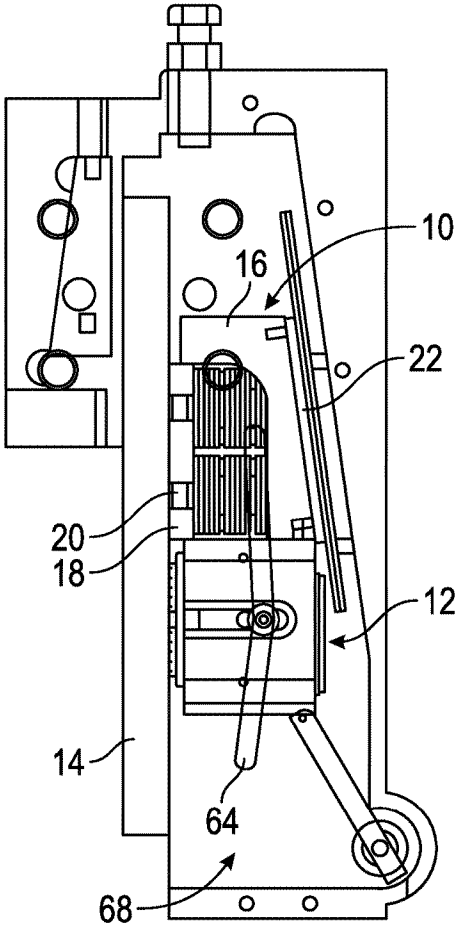
FIG. 2 is a schematic illustration of the braking system of FIG. 1 in a non-braking position.
Figure 4:
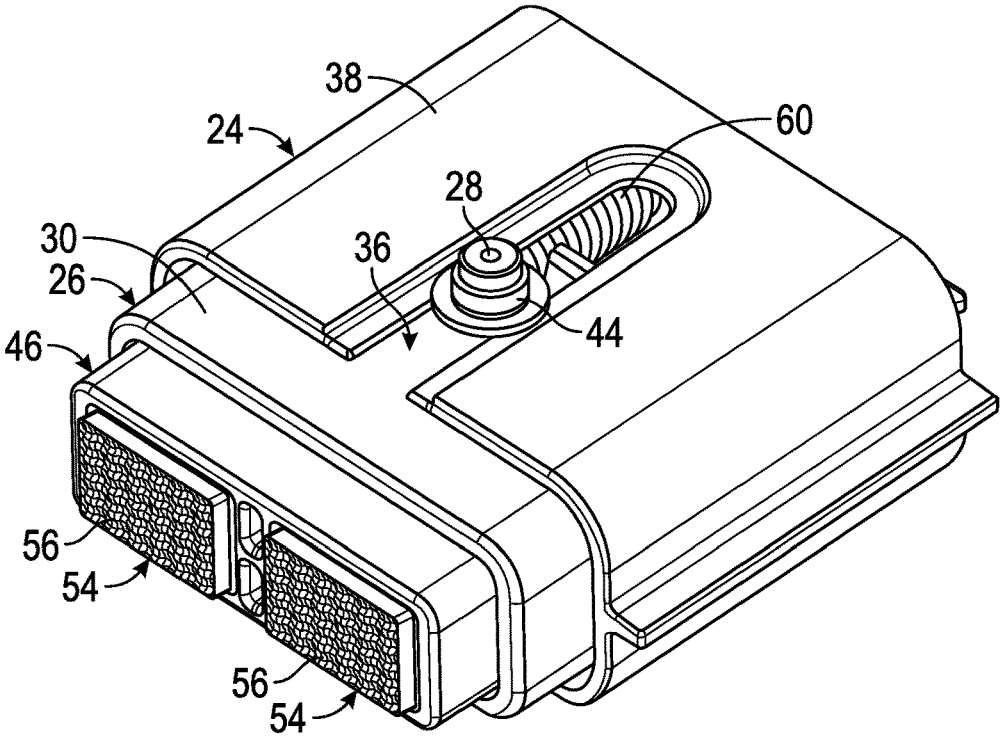
FIG. 4 is a front perspective view of a brake member actuation mechanism of the braking system of FIG. 1.
Figure 5:
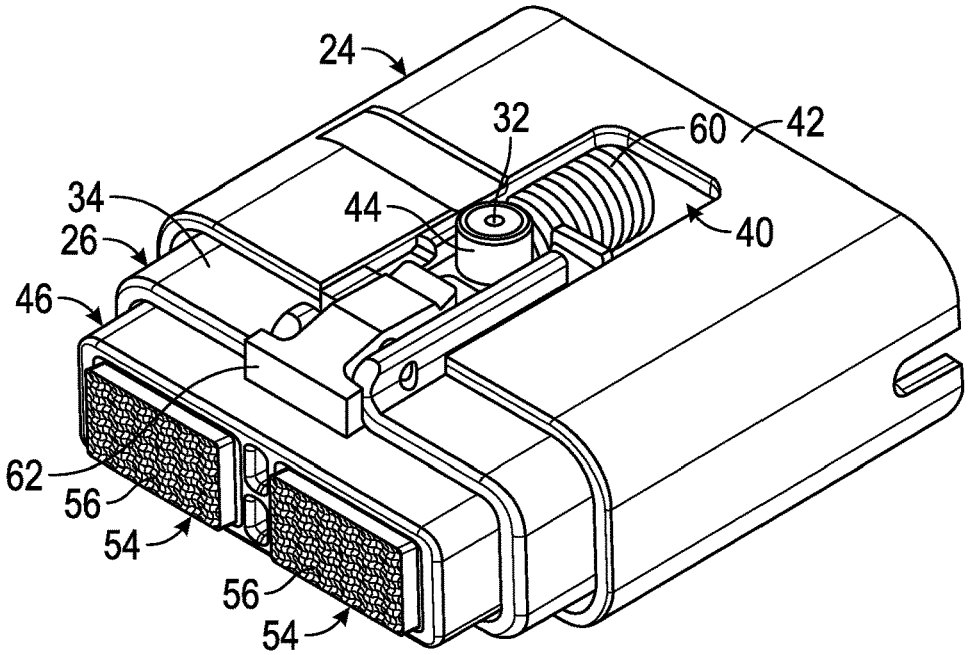
FIG. 5 is a rear perspective view of the brake member actuation mechanism of the braking system of FIG. 1.
Figure 6:
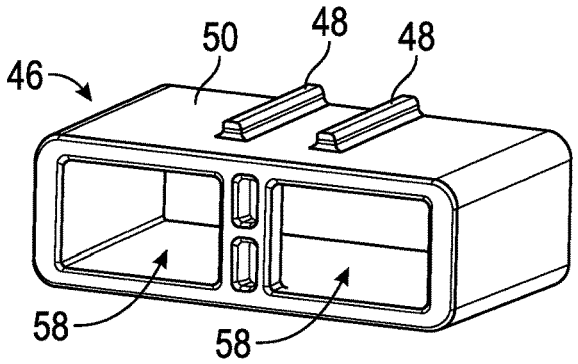
FIG. 6 is a perspective view of a brake actuator housing of the brake member actuation mechanism of the braking system of FIG. 1.
Figure 7:
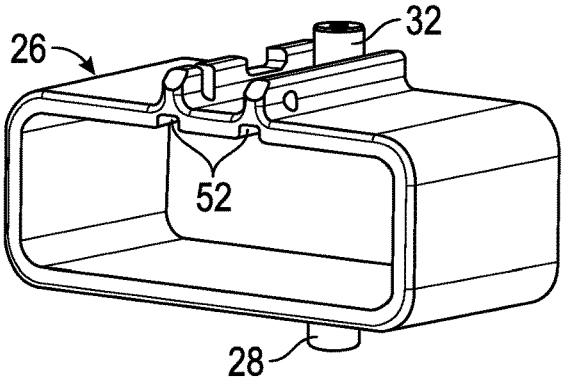
FIG. 7 is a perspective view of a slider of the brake member actuation mechanism of the braking system of FIG. 1.
Figure 8:
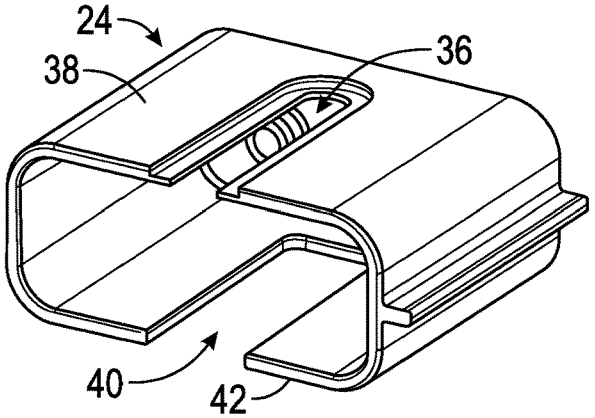
FIG. 8 is a perspective view of a container of the brake member actuation mechanism of the braking system of FIG. 1.

Referring to FIGS. 1-3, a brake member assembly 10 and an embodiment of a brake member actuation mechanism 12 are illustrated. The embodiments described herein relate to an overall braking system that is operable to assist in braking (e.g., slowing or stopping movement) of a hoisted structure (not illustrated) relative to a guide member, as will be described in detail below. The brake member assembly 10 and brake member actuation mechanism 12 can be used with various types of hoisted structures and various types of guide members, and the configuration and relative orientation of the hoisted structure and the guide member may vary. In one embodiment, the hoisted structure comprises an elevator car moveable within an elevator car passage.

Referring to FIGS. 2 and 3, with continued reference to FIG. 1, the guide member, referred to herein as a guide rail 14, is connected to a sidewall of the elevator car passage and is configured to guide the hoisted structure, typically in a vertical manner. The guide rail 14 may be formed of numerous suitable materials, typically a durable metal, such as steel, for example. Irrespective of the precise material selected, the guide rail 14 is a ferro-magnetic material.

The brake member assembly 10 includes a mounting structure 16 and a brake member 18. The brake member 18 is a brake pad or a similar structure suitable for repeatable braking engagement with the guide rail 14. The mounting structure 16 is connected to the hoisted structure and the brake member 18 is positioned on the mounting structure 16 in a manner that disposes the brake member 18 in proximity with the guide rail 14. The brake member 18 includes a contact surface 20 that is operable to frictionally engage the guide rail 14. As shown in FIGS. 2 and 3, the brake member assembly 10 is moveable between a non-braking position (FIG. 2) to a braking position (FIG. 3). The non-braking position is a position that the brake member assembly 10 is disposed in during normal operation of the hoisted structure. In particular, the brake member 18 is not in contact with the guide rail 14 while the brake member assembly 10 is in the non-braking position, and thus does not frictionally engage the guide rail 14. The brake member assembly 10 is composed of the mounting structure 16 in a manner that allows translation of the brake member assembly 10 relative to an outer component 68. Subsequent to translation of the brake member assembly 10, and more particularly the brake member 18, the brake member 18 is in contact with the guide rail 14, thereby frictionally engaging the guide rail 14. The mounting structure 16 includes a tapered wall 22 and the brake member assembly 10 is formed in a wedge-like configuration that drives the brake member 18 into contact with the guide rail 14 during movement from the non-braking position to the braking position. In the braking position, the frictional force between the contact surface 20 of the brake member 18 and the guide rail 14 is sufficient to stop movement of the hoisted structure relative to the guide rail 14. Although a single brake member is illustrated and described herein, it is to be appreciated that more than one brake member may be included. For example, a second brake member may be positioned on an opposite side of the guide rail 14 from that of the brake member 18, such that the brake members work in conjunction to effect braking of the hoisted structure.

Referring now to FIGS. 4-8, the brake member actuation mechanism is illustrated in greater detail. The brake member actuation mechanism is selectively operable to actuate movement of the brake member from the non-braking position to the braking position.

The brake member actuation mechanism 12 is formed of multiple components that are disposed within each other in a layered manner, with certain components slidably retained within other components. A container 24 is an outer member that houses several components, as will be described in detail below. The container 24 is formed of a generally rectangular cross-section and is operatively coupled to the brake member assembly 10, either directly or indirectly. The operative coupling is typically made with mechanical fasteners, but alternate suitable joining methods are contemplated.

Fitted within the container 24 is a slider 26 that is retained within the container 24, but is situated in a sliding manner relative to the container 24. The slider 26 is formed of a substantially rectangular cross-section. The slider 26 includes a first protrusion 28 extending from a first side 30 of the slider 26 and a second protrusion 32 extending from a second side 34 of the slider 26. The protrusions 28, 32 are oppositely disposed from each other to extend in opposing directions relative to the main body of the slider 26. The protrusions 28, 32 are each situated at least partially within respective slots defined by the container. In particular, the first protrusion 28 is at least partially defined within, and configured to slide within, a first slot 36 defined by a first wall 38 of the container 24 and the second protrusion 32 is at least partially defined within, and configured to slide within, a second slot 40 defined by a second wall 42 of the container 24. Fitted on each of the protrusions 28, 32 is a respective bushing 44. The protrusions 28, 32 and the slots 36, 40 are on opposing walls and provide symmetric guiding of the slider 26 during sliding movement within the container 24. The symmetric guiding of the slider, in combination with the bushings 44, provide stable motion and minimized internal friction associated with relative movement of the slider 26 and the container 24.

Disposed within the slider 26 is a brake actuator housing 46 that is formed of a substantially rectangular cross-sectional geometry, as is the case with the other layered components (i.e., container 24 and slider 26). The brake actuator housing 46 is configured to move relative to the slider 26 in a sliding manner. The sliding movement of the brake actuator housing 46 within the slider 26 may be at least partially guided by one or more guiding members 48 in the form of protrusions that extend from an outer surface 50 of the brake actuator housing 46. The slider 26 includes corresponding guiding tracks 52 formed within an inner surface of the slider 26. The brake actuator housing 46 is sized to fit within the slider 26, but it is to be appreciated that a predetermined gap may be present between the brake actuator housing 46 and the slider 26 to form a small degree of "play" between the components during relative movement.

A brake actuator 54 is disposed within the brake actuator housing 46 and, as with the other components of the brake member actuation mechanism 12, the brake actuator 54 is formed of a substantially rectangular cross-sectional geometry. The brake actuator 54 is formed of a ferro-magnetic material. A contact surface 56 of the brake actuator 54 includes a textured portion that covers all or a portion of the contact surface 56. The textured portion refers to a surface condition that includes a non-smooth surface having a degree of surface roughness. The contact surface 56 of the brake actuator 54 is defined as the portion of the brake actuator 54 that is exposed through one or more apertures 58 of the brake actuator housing 46.

In operation, an electronic sensor and/or control system (not illustrated) is configured to monitor various parameters and conditions of the hoisted structure and to compare the monitored parameters and conditions to at least one predetermined condition. In one embodiment, the predetermined condition comprises velocity and/or acceleration of the hoisted structure. In the event that the monitored condition (e.g., over-speed, over-acceleration, etc.) exceeds the predetermined condition, the brake actuator 54 is actuated to facilitate magnetic engagement of the brake actuator 54 and the guide rail 14. Various triggering mechanisms or components may be employed to actuate the brake member actuation mechanism 12, and more specifically the brake actuator 54. In the illustrated embodiment, two springs 60 are located within the container 24 and are configured to exert a force on the brake actuator housing 46 to initiate actuation of the brake actuator 54 when latch member 62 is triggered. Although two springs are referred to above and illustrated, it is to be appreciated that a single spring may be employed or more than two springs. Irrespective of the number of springs, the total spring force is merely sufficient to overcome an opposing retaining force exerted on the brake actuator housing 46 and therefore the brake actuator 54. The retaining force comprises friction and a latch member 62 that is operatively coupled to the slider 26 and configured to engage the brake actuator housing 46 in a retained position.

As the brake actuator 54 is propelled toward the guide rail 14, the magnetic attraction between the brake actuator 54 and the guide rail 14 provides a normal force component included in a friction force between the brake actuator 54 and the guide rail 14. As described above, a slight gap may be present between the brake actuator housing 46 and the slider 26. Additionally, a slight gap may be present between the slider 26 and the container 24. In both cases, the side walls of the container 24 and/or the slider 26 may be tapered to define a non-uniform gap along the length of the range of travel of the slider 26 and/or the brake actuator housing 46. As noted above, a degree of play between the components provides a self-aligning benefit as the brake actuator 54 engages the guide rail 14. In particular, the normal force, and therefore the friction force, is maximized by ensuring that the entire contact surface 56 of the brake actuator 54 is in flush contact with the guide rail 14. The engagement is further enhanced by the above-described textured nature of the contact surface 56. Specifically, an enhanced friction coefficient is achieved with low deviation related to the surface condition of the guide rail 14. As such, a desirable friction coefficient is present regardless of whether the surface of the guide rail 14 is oiled or dried.

Upon magnetic engagement between the contact surface 56 of the brake actuator 54 and the guide rail 14, the frictional force causes the overall brake member actuation mechanism 12 to move upwardly relative to slots 64 within an outer component 68, such as a guiding block and/or cover (FIGS. 2 and 3). The relative movement of the brake member actuation mechanism 12 actuates similar relative movement of the brake member assembly 10. The relative movement of the brake member assembly 10 forces the contact surface 20 of the brake member 18 into frictional engagement with the guide rail 14, thereby moving to the braking position and slowing or stopping the hoisted structure, as described in detail above.

Figure 10:
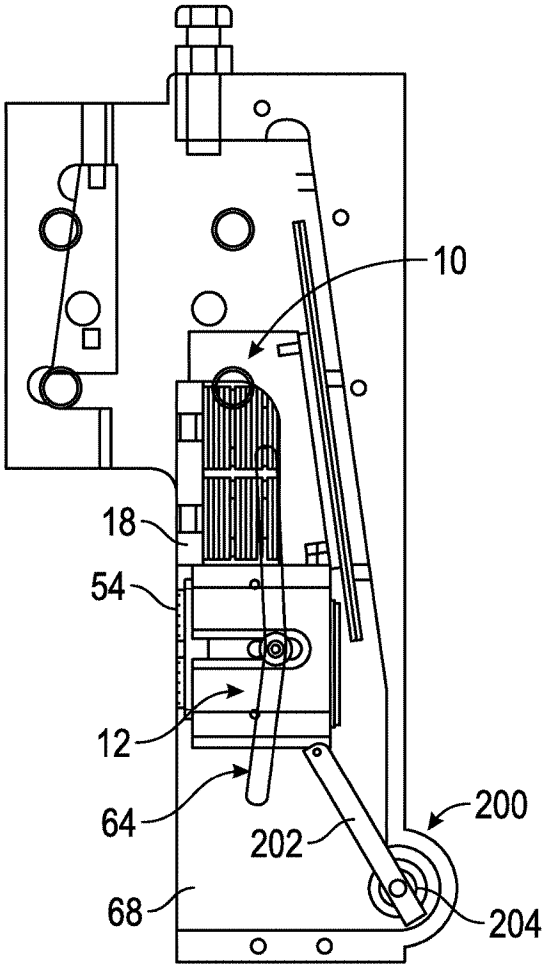
FIG. 10 is a schematic illustration of the resetting device of FIG. 9, with the resetting device in a default state.
Figure 9:
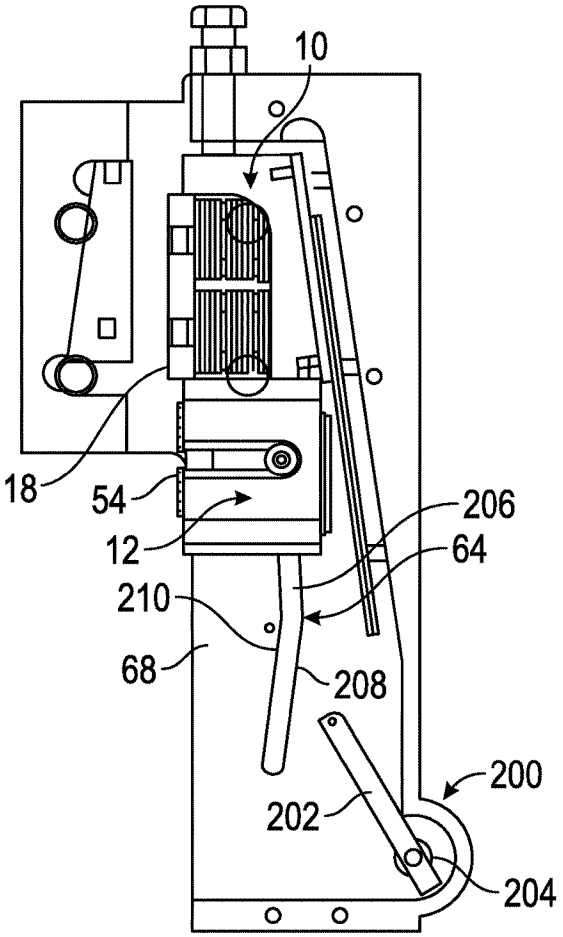
FIG. 9 is a schematic illustration of a resetting device according to a first embodiment for the braking system of FIG. 1, with the brake member actuation mechanism in an actuated state.
Figure 13:
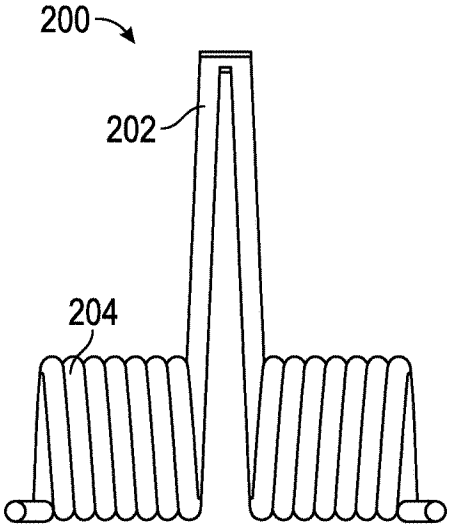
FIG. 13 is a perspective view of the resetting device of FIG. 9 according to another aspect.
Figure 12:
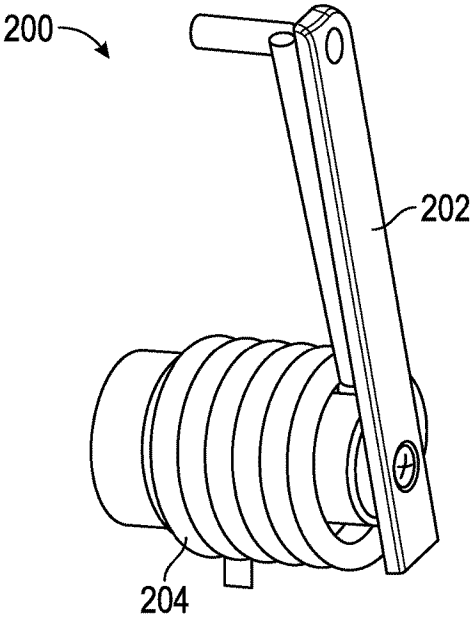
FIG. 12 is a perspective view of the resetting device of FIG. 9 according to one aspect.
Figure 11:
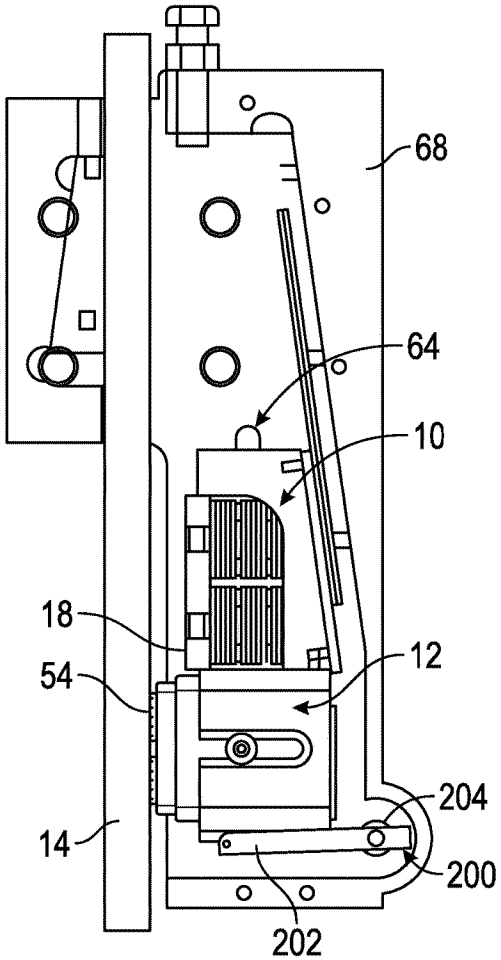
FIG. 11 is a schematic illustration of the resetting device of FIG. 9, with the resetting device in a reset state.

Referring now to FIGS. 9-11, a braking system resetting mechanism 200 according to a first embodiment is illustrated and is employed in conjunction with the brake member actuation mechanism 12 in order to reset the brake member actuation mechanism 12 to a default condition (FIG. 10) from an actuated condition (FIG. 9). The braking system resetting mechanism 200 includes a lever 202 that is operatively coupled to the outer component 68 proximate a lower portion thereof. The lever 202 is operatively coupled to a torsional spring 204 (FIGS. 12 and 13) that biases the lever 202 in a clockwise direction, as shown in the illustrated embodiments of FIGS. 9-11. The torsional spring 204 may be a single-sided spring (FIG. 12) or a double-sided spring (FIG. 13). In particular, the torsional spring 204 may be disposed on one side of the lever 202 or both sides of the lever 202.

In operation, after actuation of the brake member assembly 10, the brake member actuation mechanism 12 is disposed in the braked position, also referred to herein as an actuated state, position or condition, as shown in FIG. 9. To reset the brake member assembly 10, the hoisted structure is raised slightly to facilitate relative downward movement of the brake member 18 and the brake actuator 54, with respect to the outer component 68. As the brake actuator 54 moves downward relative to the outer component 68, engagement is made with the lever 202, as shown in FIG. 10. This engagement occurs between the actuated state and a reset state that is illustrated in FIG. 11. As described above, the brake member actuation mechanism 12 is guided by the slots 64 of the outer component 68. The slots 64 include a first angled segment 206 and a second angled segment 208, with the intersection of the two being an outer location 210. Although the brake member actuation mechanism 12 is guided outwardly toward the outer location 210 during downward movement, the magnetic attraction between the brake member actuation mechanism 12 and the guide rail 14 is often sufficient to maintain engagement, thereby inhibiting resetting of the brake member assembly 10.

To overcome the magnetic attraction between the brake member actuation mechanism 12 and the guide rail 14, the system is moved to the reset state of FIG. 11 and the hoisted structure is then lowered to allow the lever 202 that is spring biased by the torsional spring 204 to abruptly force the brake member actuation mechanism 12 upwardly and toward the outer location 210 of the slot 206. The assist generated by the spring force is sufficient to overcome the magnetic attraction between the brake member actuation mechanism 12 and the guide rail 14, thereby returning the overall system to a default state or condition, as shown in FIG. 10.

Figure 15:
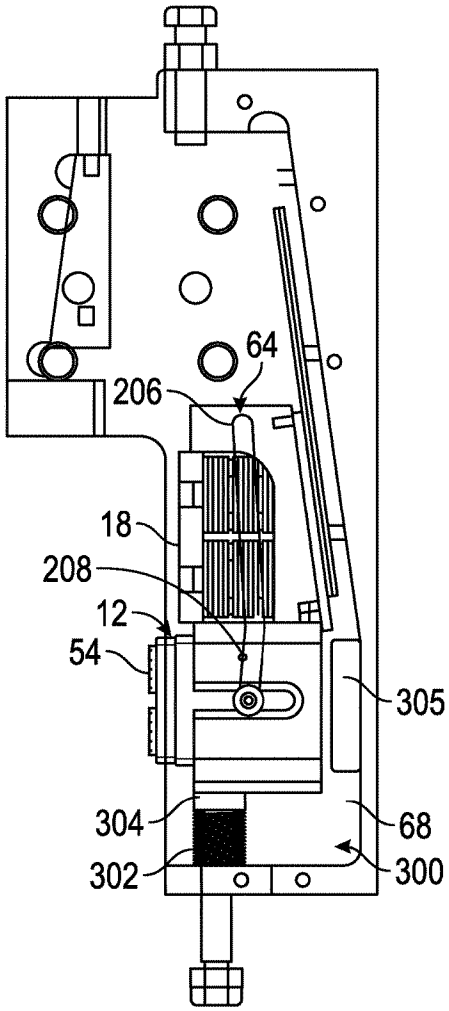
FIG. 15 is a schematic illustration of the resetting device of FIG. 14, with the resetting device in a reset state.
Figure 14:
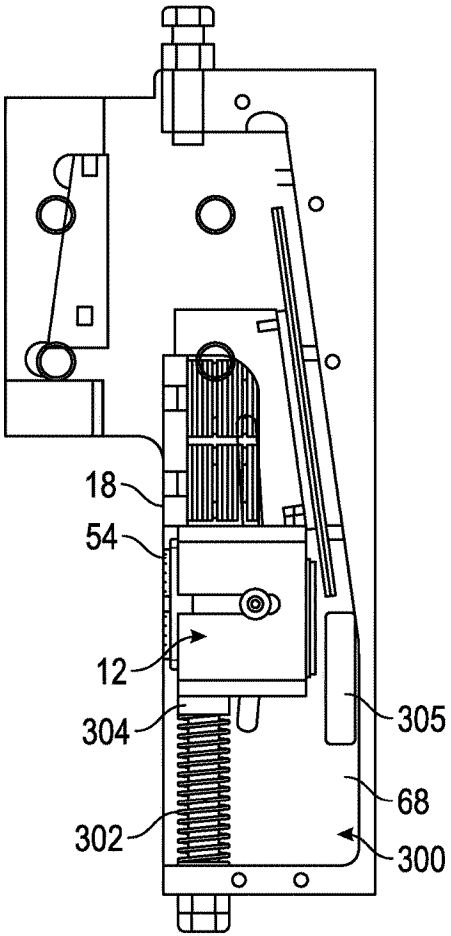
FIG. 14 is a schematic illustration of a resetting device according to a second embodiment for the braking system of FIG. 1, with the resetting device in a default state.
Figure 16:
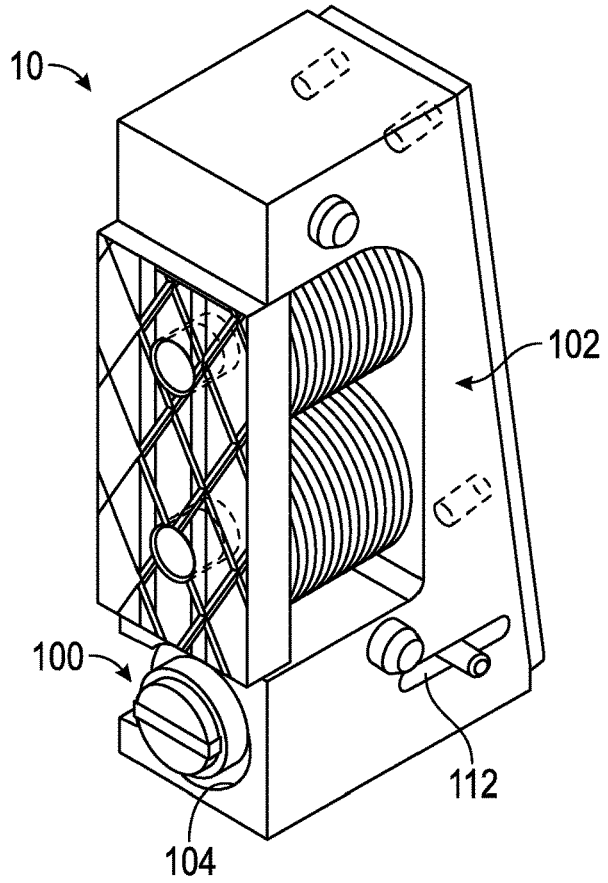
FIG. 16 is a perspective view of a braking system for a hoisted structure according to a second embodiment.
Figure 17:
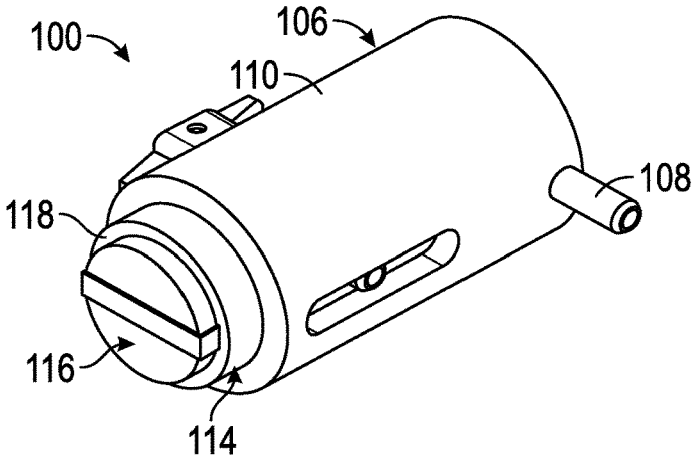
FIG. 17 is a perspective view of a brake member actuation mechanism of the braking system of FIG. 16.
Figure 18:
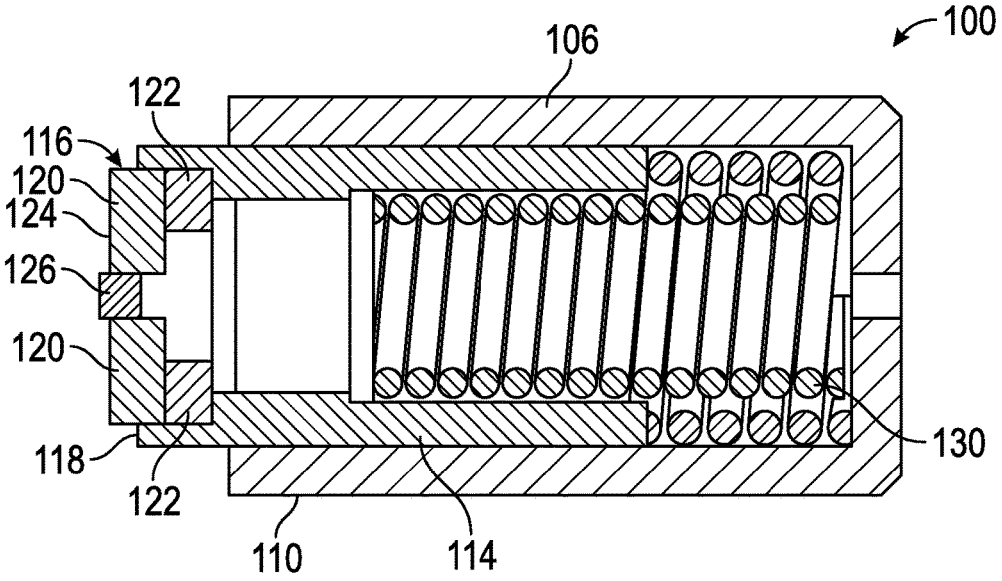
FIG. 18 is a cross-sectional view of the brake member actuation mechanism of the braking system of FIG. 16.
Figure 19:
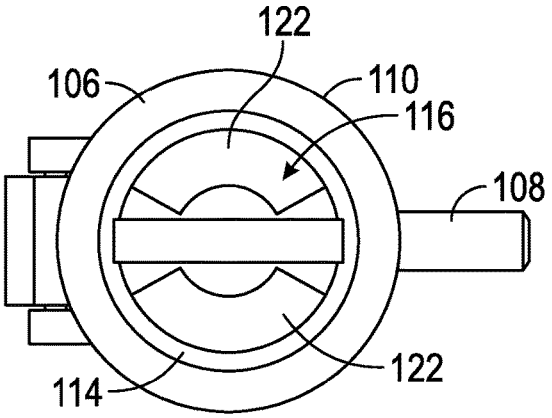
FIG. 19 is a front view of the brake member actuation mechanism of the braking system of FIG. 16.

Referring now to FIGS. 14 and 15, a braking system resetting mechanism 300 according to another embodiment is illustrated. The illustrated embodiment is similar to the embodiment described above, however, does not rely solely on a spring loaded lever. Rather, a linear spring 302 is operatively coupled to the outer component 68 and positioned to have an end 304 in contact with the brake member actuation mechanism 12.

In operation, the hoisted structure is raised slightly to facilitate relative downward movement of the brake member 18 and the brake actuator 54, with respect to the outer component 68. As the brake member actuation device 54 moves downward relative to the outer component 68, engagement is made with the spring 302, as shown in FIG. 14. This engagement occurs between the actuated state and a reset state. As described above, the brake member actuation mechanism 12 is guided by the slots 64 of the outer component 68. The slots 64 include a first angled segment 206 and a second angled segment 208, with the intersection of the two being an outer location 210. As described above in conjunction with the first embodiment, although the brake member actuation mechanism 12 is guided outwardly toward the outer location 210 during downward movement, the magnetic attraction between the brake member actuation mechanism 12 and the guide rail 14 is often sufficient to maintain engagement, thereby inhibiting resetting of the braking system 10. During this movement, an electromagnetic device 305 is configured to come into close or direct contact with the brake member actuation mechanism 12. Specifically, the electromagnetic device 305 is operatively coupled to the outer component 68 proximate an end 306 of the brake member actuation mechanism 12. The electromagnetic device 305 comprises a ferrite material that is configured to magnetically attract the brake member actuation mechanism 12 when in an activated state. It is contemplated that the electromagnetic device 305 may sufficiently overcome the magnetic contact between the brake member actuation mechanism 12 and the guide rail 14.

In the event the electromagnetic device 305 does not sufficiently break the contact, the spring 302 assists in the effort. To overcome the magnetic attraction between the brake member actuation mechanism 12 and the guide rail 14, the system is moved to the reset state (FIG. 15) and the hoisted structure is then lowered to allow the spring 302 to abruptly force the brake member actuation mechanism 12 upwardly and toward the outer location 210 of the slot 206. The assist generated by the spring force is sufficient to overcome the magnetic attraction between the brake member actuation mechanism 12 and the guide rail 14, thereby returning the overall system to a default state or condition.

Referring now to FIGS. 16-19, a brake member actuation mechanism 100 according to another embodiment is illustrated. The brake member actuation mechanism 100 is configured to actuate movement of the brake member assembly 10 from the non-braking position to the braking position. The structure and function of the brake member assembly 10, including the brake member 18 that includes the contact surface 20 that frictionally engages the guide rail 14 in the braking position, has been described above in detail. The illustrated embodiment provides an alternative structure for actuating braking of the hoisted structure. As with the embodiments described above, two or more brake assemblies (e.g., brake members with a contact surface), as well as two or more brake member actuation mechanisms may be included to effect braking of the hoisted structure.

As shown, a single component, which may be wedge-like in construction, forms a body 102 for both the brake member assembly 10 and the brake member actuation mechanism 100. The brake member actuation mechanism 100 includes a container 104. In one embodiment, the container 104 is a cavity defined by the body 102, thereby being integrally formed therein. In another embodiment, the container 104 is an insert that is fixed within the body 102. In the illustrated embodiment, the container 104 is formed of a substantially circular cross-sectional geometry, however, it is to be understood that alternative geometries may be suitable.

Fitted within the container 104 is a slider 106 that is retained within the container 104, but is situated in a sliding manner relative to the container 104. The slider 106 is formed of a substantially circular cross-section, but alternative suitable geometries are contemplated as is the case with the container 104. The slider 106 includes at least one protrusion 108 extending from an outer surface 110 of the slider 106. The protrusion 108 is situated at least partially within a slot 112 defined by the container 104 and extends through the body 102. In particular, the protrusion 108 is configured to slide within the slot 112.

Disposed within the slider 106 is a brake actuator housing 114 that is formed of a substantially circular cross-sectional geometry, as is the case with the other layered components (i.e., container 104 and slider 106), but alternative suitable geometries are contemplated. The brake actuator housing 114 is configured to move relative to the slider 106 in a sliding manner.

A brake actuator 116 is located proximate an end 118 of the brake actuator housing 114. The brake actuator 116 comprises at least one brake pad 120 that is formed of a ferro-magnetic material and one or more magnets 122. In one embodiment, the at least one magnet 122 is a half-ring magnet. The term half-ring magnet is not limited to precisely a semi-circle. Rather, any ring segment may form the magnet 122 portion(s). The at least one brake pad 120 disposed on an outer end of the magnet 122 is a metallic material configured to form a contact surface 124 of the brake actuator 116. The contact surface 124 is configured to engage the guide rail 14 and effect a friction force to actuate the brake member assembly 10 from the non-braking position to the braking position. A bumper 126 may be included to reduce the shock force associated with the initial contact between the brake pad 120 and the guide rail 14, which is particularly beneficial if the brake pad metallic material is brittle.

As described in detail above with respect to alternative embodiments, an electronic sensor and/or control system (not illustrated) is configured to monitor various parameters and conditions of the hoisted structure and to compare the monitored parameters and conditions to at least one predetermined condition. In response to the detection of the hoisted structure exceeding the predetermined condition, a triggering mechanism or component propels the brake actuator 116 into magnetic engagement with the guide rail 14. In one embodiment, a single or dual spring 130 arrangement is employed and is located within the container 104 and is configured to exert a force on the brake actuator housing 114 and/or the slider 106 to initiate actuation of the brake member actuation mechanism 100.

The magnetic engagement of the brake actuator 116 and the guide rail 14 has been described in detail above, as well as the actuation of the brake member assembly 10 from the non-braking position to the braking position, such that duplicative description is omitted for clarity.

Figure 20:
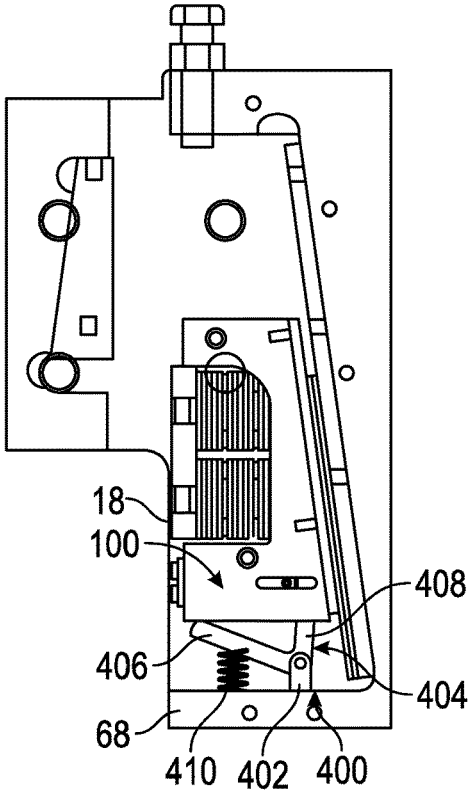
FIG. 20 is a schematic illustration of a resetting device according to a third embodiment for the braking system of FIG. 16.

Referring to FIG. 20, a braking system resetting mechanism 400 according to another embodiment is illustrated. A pivot support 402 is operatively coupled to the outer component 68 proximate a lower region. Pivotally coupled to the pivot support 402 is a fork member 404. The fork member 404 includes a first segment 406 and a second segment 408 angularly displaced from each other.

In operation, the hoisted structure is raised slightly to facilitate relative downward movement of the brake member 18 and the brake member actuation mechanism 100, with respect to the outer component 68. As the brake member actuation mechanism 100 moves downward relative to the outer component 68, engagement is made with the first segment 406 of the fork member 404. This engagement occurs between the actuated state and a reset state. In the illustrated view, the engagement and further downward movement of the brake member actuation mechanism 100 causes the fork member 404 to rotate in a counter-clockwise direction. Simultaneously, the second segment 408 of the fork member 404 engages the brake member actuation mechanism 100 and forces the brake member actuation mechanism 100 against the guide rail 14. This generates an increased normal force and leads to a greater friction force. This process continues until the aforementioned reset state is achieved. Subsequently, as described above in conjunction with alternative embodiments, the hoisted structure is moved downwardly to reverse the friction force direction and reduces the force to zero when a gap is created between the guide rail 14 and the brake member actuation mechanism 100. Additionally, a return spring 410 is included between the outer component 68 and the first segment 406 of the fork member 404 and biases the brake member actuation mechanism 100 toward the default position and the overall system is ready to be actuated once more.

Figure 21:
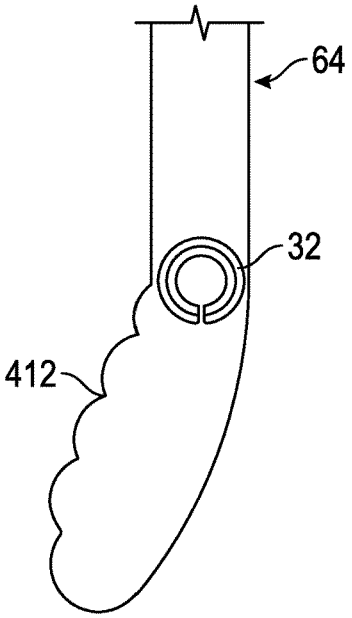
FIG. 21 is a schematic illustration of a resetting device according to a fourth embodiment.

Referring to FIG. 21, as described above, the brake member actuation mechanism 100 is guided by the slot 64 of the outer component 68. In the illustrated embodiment, at least a portion of the slot 64 includes a plurality of ridges 412 that define "bump" features within the slot 64. At each bump, the guiding pin 32 will try to push the brake member actuation mechanism 100 away from the guide rail 14 to cause disengagement. This feature may be used with any of the aforementioned embodiments of the brake system resetting mechanism.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A braking system resetting mechanism for a hoisted structure comprising:

a guide rail configured to guide movement of the hoisted structure;

a brake member operatively coupled to the hoisted structure and having a brake surface configured to frictionally engage the guide rail, the brake member moveable between a braking position and a non-braking position;

a brake member actuation mechanism operatively coupled to the brake member and configured to magnetically engage the guide rail to actuate the brake member from the non-braking position to the braking position;

an outer structure having a slot configured to guide the brake member actuation mechanism, wherein the slot includes a first angled region and a second angled region that intersect at an outer location; and a spring loaded lever operatively coupled to the outer structure and configured to engage the brake member actuation mechanism during a resetting operation, wherein the spring loaded lever biases the brake member actuation mechanism toward the outer location of the slot of the outer structure to disengage the brake member actuation mechanism from the guide rail.

2. The braking system resetting mechanism of claim 1, wherein the spring loaded lever comprises a torsional spring.

3. The braking system resetting mechanism of claim 2, wherein the torsional spring is a single spring located on one side of the spring loaded lever.

4. The braking system resetting mechanism of claim 2, wherein the torsional spring is a double spring located on two sides of the spring loaded lever.

5. The braking system resetting mechanism of claim 2, wherein the brake member actuation mechanism is moveable relative to the outer structure from an actuated state to a reset state.

6. The braking system resetting mechanism of claim 5, wherein the brake member actuation mechanism slides downwardly relative to the outer structure as the hoisted structure is raised.

7. The braking system resetting mechanism of claim 6, wherein the brake member actuation mechanism engages the spring loaded lever during movement from the actuated state to the reset state.

8. The braking system resetting mechanism of claim 7, wherein the spring loaded lever rotationally biases the brake member actuation mechanism out of contact from the guide rail to a default state as the hoisted structure is lowered.

9. The braking system resetting mechanism of claim 1, wherein the brake member actuation mechanism comprises:

a container operatively coupled to the brake member;

a brake actuator formed of a magnetic material disposed within the container and configured to be electronically actuated to magnetically engage the guide rail upon detection of the hoisted structure exceeding a predetermined condition, wherein the magnetic engagement of the brake actuator and the guide rail actuates movement of the brake member into the braking position;

a brake actuator housing that directly contains the brake actuator; and a slider at least partially surrounding the brake actuator housing and slidably disposed within the container.

10. A braking system resetting mechanism for a hoisted structure comprising:

a guide rail configured to guide movement of the hoisted structure;

a brake member operatively coupled to the hoisted structure and having a brake surface configured to frictionally engage the guide rail, the brake member moveable between a braking position and a non-braking position;

a brake member actuation mechanism operatively coupled to the brake member and configured to magnetically engage the guide rail to actuate the brake member from the non-braking position to the braking position;

an outer structure having a slot configured to guide the brake member actuation mechanism, wherein the slot includes a first angled region and a second angled region that intersect at an outer location; and an electromagnetic device operatively coupled to the outer structure and located proximate an end of the brake member actuation mechanism in a reset state of the brake member actuation mechanism, wherein the electromagnetic device biases the brake member actuation mechanism toward the outer location of the slot of the outer structure to disengage the brake member actuation mechanism from the guide rail.

11. The braking system resetting mechanism of claim 10, wherein the electromagnetic device comprises a ferrite material configured to magnetically attract the brake member actuation mechanism during an activated state of the electromagnetic device to oppose the magnetic attraction of the brake member actuation device to the guide rail.

12. The braking system resetting mechanism of claim 10, further comprising a spring configured to bias the brake member actuation mechanism toward the outer location of the slot of the outer structure to disengage the brake member actuation mechanism from the guide rail.

13. The braking system resetting mechanism of claim 12, wherein the brake member actuation mechanism is moveable relative to the outer structure from an actuated state to a reset state.

14. The braking system resetting mechanism of claim 13, wherein the brake member actuation mechanism slides downwardly relative to the outer structure as the hoisted structure is raised.

15. The braking system resetting mechanism of claim 14, wherein the brake member actuation mechanism engages the spring and the electromagnetic device during movement from the actuated state to the reset state.

16. The braking system resetting mechanism of claim 10, wherein the brake member actuation mechanism comprises:

a container operatively coupled to the brake member;

a brake actuator formed of a magnetic material disposed within the container and configured to be electronically actuated to magnetically engage the guide rail upon detection of the hoisted structure exceeding a predetermined condition, wherein the magnetic engagement of the brake actuator and the guide rail actuates movement of the brake member into the braking position;

a brake actuator housing that directly contains the brake actuator; and a slider at least partially surrounding the brake actuator housing and slidably disposed within the container.

17. A braking system resetting mechanism for a hoisted structure comprising:

a guide rail configured to guide movement of the hoisted structure;

a brake member operatively coupled to the hoisted structure and having a brake surface configured to frictionally engage the guide rail, the brake member moveable between a braking position and a non-braking position;

a brake member actuation mechanism operatively coupled to the brake member and configured to magnetically engage the guide rail to actuate the brake member from the non-braking position to the braking position;

an outer structure having a slot configured to guide the brake member actuation mechanism, wherein the slot includes a first angled region and a second angled region that intersect at an outer location;

a fork member having a first segment and a second segment, the fork member pivotally coupled to the outer structure, wherein the first segment and the second segment are configured to engage the brake member actuation mechanism; and a spring configured to bias the first segment of the fork member to disengage the brake member actuation mechanism from the guide rail.

18. The braking system resetting mechanism of claim 17, wherein the second end of the fork member is configured to bias the brake member actuation mechanism toward the guide rail to increase a friction force between the brake member actuation mechanism and the guide rail.

19. The braking system resetting mechanism of claim 17, further comprising a plurality of ridges along the slot, wherein each of the plurality of ridges biases the brake member actuation mechanism away from the guide rail.

* * * * *